US006367783B1

(12) United States Patent
Raftis

(10) Patent No.: US 6,367,783 B1
(45) Date of Patent: Apr. 9, 2002

(54) FINE BUBBLE DIFFUSER

(75) Inventor: Spiros G. Raftis, Pittsburgh, PA (US)

(73) Assignee: Red Valve Company, Inc., Carnegie, PA (US)

( * ) Notice: Subject to any disclaimer, the term of this patent is extended or adjusted under 35 U.S.C. 154(b) by 0 days.

(21) Appl. No.: 09/720,386

(22) PCT Filed: Jun. 23, 1999

(86) PCT No.: PCT/US99/14227

§ 371 Date: Feb. 28, 2001

§ 102(e) Date: Feb. 28, 2001

(87) PCT Pub. No.: WO99/67014

PCT Pub. Date: Dec. 29, 1999

Related U.S. Application Data

(60) Provisional application No. 60/000,599, filed on Jun. 23, 1998, now abandoned, and provisional application No. 60/101,177, filed on Sep. 21, 1998, now abandoned.

(51) Int. Cl.[7] ..... B01F 3/04

(52) U.S. Cl. ..... 261/122.1; 261/122.2

(58) Field of Search ..... 261/122.1, 122.2, 261/124, DIG. 70

(56) References Cited

U.S. PATENT DOCUMENTS

| | | | | |
|---|---|---|---|---|
| 3,997,634 A | 12/1976 | Downs | ..... | 261/122 |
| 4,288,394 A | 9/1981 | Ewing et al. | ..... | 261/122 |
| 4,848,749 A | 7/1989 | Schneider | ..... | 261/602 |
| 4,981,623 A | 1/1991 | Ryan | ..... | 261/122 |
| 5,158,715 A | 10/1992 | Jager | ..... | 261/122.1 |
| 5,480,593 A | 1/1996 | Marcum et al. | ..... | 261/77 |
| 5,858,283 A | 1/1999 | Burris | ..... | 261/122.1 |

FOREIGN PATENT DOCUMENTS

| | | | |
|---|---|---|---|
| DE | 3600232 | 7/1987 | |
| GB | 824376 | 11/1959 | ..... 261/122.2 |

OTHER PUBLICATIONS

Brochure by Water Pollution Control Corp., "Ceramic Grid Aeration System", 1991, entire document.

Brochure by Diffused Gas Technologies, Inc., "Gas Diffusers for Water and Wastewater Treatment", (no date), entire document.

Brochure by Red Valve Company, Inc., "Air Diffuser Check Valves", (no date), entire document.

*Primary Examiner*—C. Scott Bushey
(74) *Attorney, Agent, or Firm*—Webb Ziesenheim Logsdon Orkin & Hanson, P.C.

(57) ABSTRACT

A diffuser includes a substantially rigid base member having a first side and a second side, and an inlet conduit defining a central bore depending from the second side of the base member. A resilient dome member having a plurality of perforations is sealed to a peripheral edge of the first side of the base member. A coupling member, preferably in the form of a check valve, provides cooperation with a fluid source. As the diffuser is pressurized the dome member expands away from the base member and fluid is diffused by the perforations.

17 Claims, 12 Drawing Sheets

FINE BUBBLE DIFFUSER

This application is filed under 35 U.S.C. 371 as the national stage application of PCT/US99/14227, filed on Jun. 23, 1999. The PCT application claims domestic priority under 35 U.S.C. 119(e) to U.S. provisional application No. 60/090,599, filed Jun. 23, 1998, now abandoned, and to U.S. provisional application No. 60/101,177, filed Sep. 21, 1998, now abandoned.

BACKGROUND OF THE INVENTION

1. Field of the Invention

The present invention relates to diffusers and, more particularly, to air diffusers for treating wastewater in wastewater treatment plants.

2. Description of the Prior Art

In wastewater treatment plants, it is known to aerate effluent, or sludge, as part of the wastewater purification process. This process is commonly known as the "activated" sludge process. In the activated sludge process, air is introduced near the bottom of an aeration tank containing wastewater and bacterial floc via a system of pipes and/or hoses. As the air rises to the surface as air bubbles, some of the oxygen in the air is transferred to the wastewater and is consumed by the bacteria during digestion which aids in the treatment of sewage. One prior art sludge aeration tank utilizes rubber check valves or the like to provide air to the wastewater. It is also known to use air diffusers in the shape of a dome in the activated sludge process. These air diffusers are typically made of porous ceramic or plastic.

There are several common problems with domed air diffusers (hereinafter "air diffusers") which are currently used in the activated sludge process. For example, some current state-of-the-art air diffusers cannot prevent the backflow of sludge and algae into the air supply source. To overcome this disadvantage, the air supply source must run continuously to prevent the backflow of sludge into the air supply source. As a result, energy consumption of the air supply source, typically an air compressor, is usually the single most expensive cost in the operation of wastewater treatment plants. In the event the air supply to the air diffuser is shut off, sludge, organic matter and other debris will back into the air supply source and foul the air compressor and its controls.

In addition, prior art air diffusers easily become plugged with accumulated algae and sludge that settles on and within the air diffuser during the activated sludge process. Consequently, it would be beneficial to provide an air diffuser which overcomes these disadvantages in the prior art.

It is therefore an object of the present invention to provide an air diffuser that can prevent backflow into the air diffuser's air supply source, without the need to continuously run air through the air diffuser.

It is a further object of the present invention to provide an air diffuser capable of providing aeration to sludge in wastewater treatment plants without becoming easily plugged with organic material.

SUMMARY OF THE INVENTION

The above objects are satisfied with a diffuser for diffusing a process fluid made in accordance with the present invention. The diffuser generally includes a base member having a first side and a second side, with the base member having an inlet conduit depending from the second side. The inlet conduit defines a central bore extending through the base member. A resilient dome member is sealed to the first side of the base member at a peripheral edge of the first side of the base member. The dome member defines a plurality of perforated holes extending therethrough. A coupling member is at least partially positioned within the central bore and configured to cooperate with an external process fluid source.

In a pressurized state of the diffuser, the process fluid flows through the central bore and expands the dome member such that a cavity forms between an inner surface of the dome member and the first side of the base member. In addition, in the pressurized state of the diffuser, the process fluid diffuses from the diffuser through the perforated holes in the dome member.

The dome member and the coupling member may be integrally formed as part of the base member. The dome member may include at least one elastomer ply, with a plurality of perforated holes defined therethrough. The dome member may further include a nonperforated area opposite the central bore. In an unpressurized state of the diffuser, the nonperforated area may contact the first side of the base member and may seal the central bore from backflow therethrough.

The coupling member may be a check valve. The base member may be made of a high durometer rubber of about 90 Shore A, and the dome member may be made of a low durometer rubber of about 45 Shore A. A distribution of the plurality of perforated holes in the dome member is preferably about 32 holes/inch$^2$. In the pressurized state of the diffuser, the cavity may have a semicircular-shaped or polygonal-shaped cross section.

In a second embodiment of the present invention, the diffuser includes a base member having a first side and a second side. The base member defines a longitudinally extending inlet having an inlet opening. A resilient dome member is sealed to the first side of the base member at a peripheral edge of the first side such that a first portion of the dome member encloses the inlet conduit and the inlet opening. A second portion of the dome member defines a plurality of perforated holes extending therethrough. A coupling member is at least partially positioned within the inlet conduit and configured to cooperate with an external process fluid source.

In a pressurized state of the diffuser, the process fluid flows through the inlet conduit such that the dome member expands and forms a cavity between an inner surface of the dome member and the first side of the base member. In addition, in the pressurized state of the diffuser, the process fluid diffuses through the perforated holes defined in the second portion of the dome member. In an unpressurized state of the diffuser, the first portion of the dome member contacts the first side of the base member and seals the inlet opening from backflow.

The first portion of the dome member may further include a nonperforated area opposite the inlet opening of the inlet conduit. In an unpressurized state of the diffuser, the nonperforated area may contact the first side of the base member and may seal the inlet opening from backflow therethrough. In addition, the diffuser, in this embodiment, may include a longitudinally extending flop zone formed by the base member and the dome member immediately adjacent the inlet opening of the inlet conduit. The present invention also includes a method of using a diffuser to diffuse a process fluid.

Further details and advantages of the present invention will become apparent from the following detailed description in conjunction with the accompanying drawings, wherein like parts in succeeding embodiments are designated with primed reference numerals.

DETAILED DESCRIPTION OF THE PREFERRED EMBODIMENTS

Referring to FIGS. 1–4, a first embodiment of a diffuser 10 for diffusing a process fluid, in accordance with the present invention, is shown. The diffuser 10 generally includes a unitary and substantially rigid base member 12 and a resilient and inflatable dome member 14 connected to the base member 12.

Figure 3:
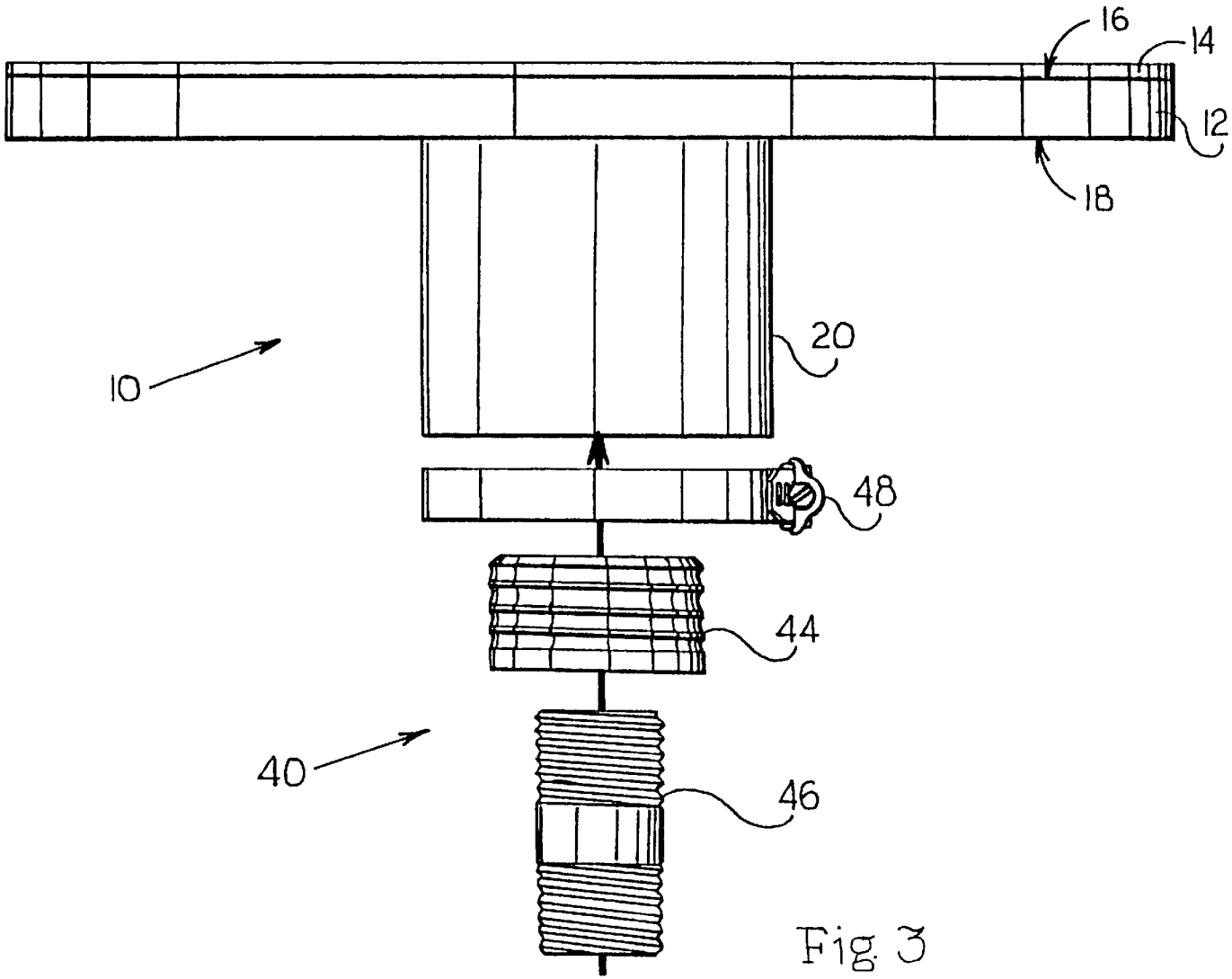
FIG. 3 is an exploded side view of the diffuser shown in FIG. 1.
Figure 4:
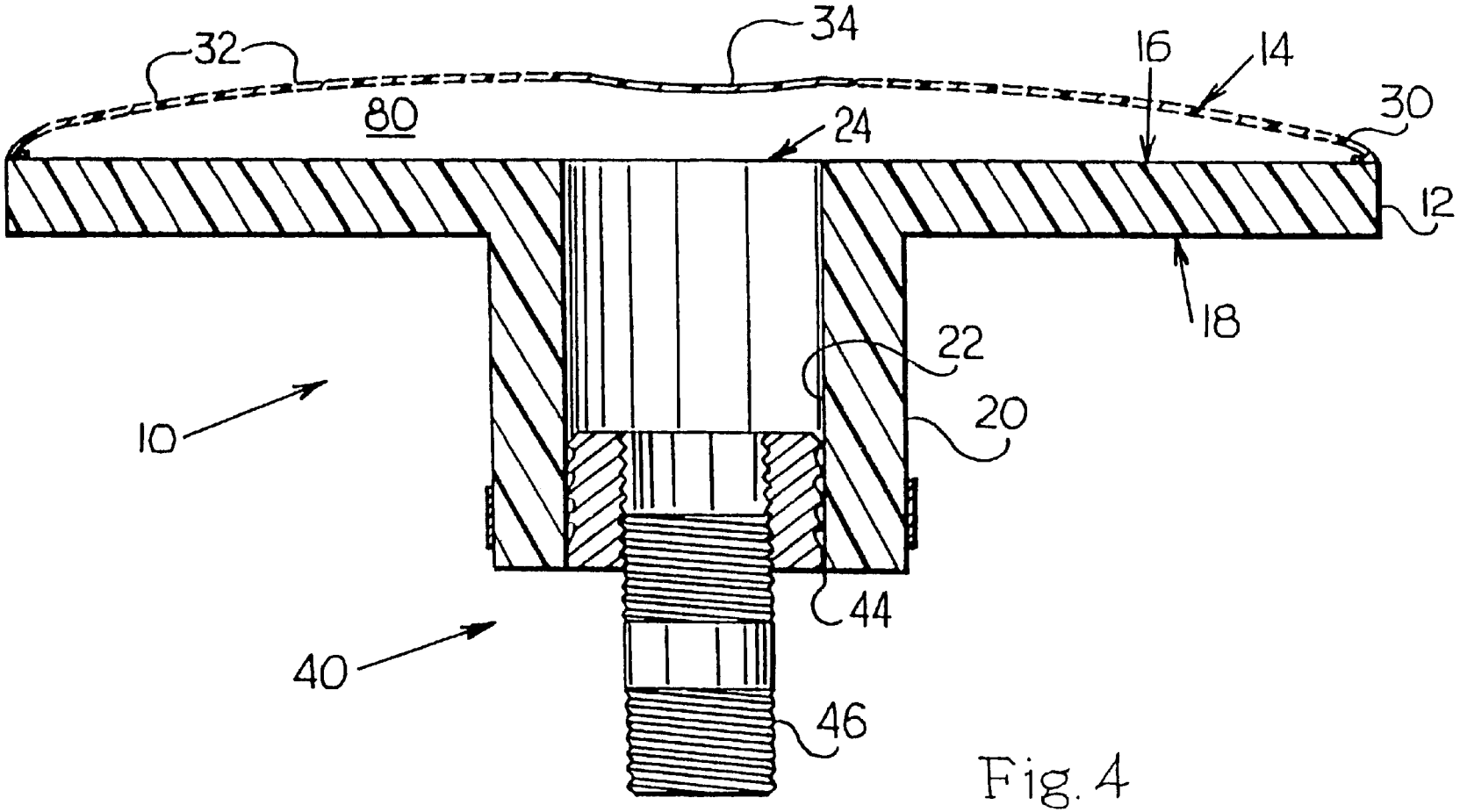
FIG. 4 is a cross-sectional view of the diffuser shown in FIG. 1, with the diffuser in a pressurized state.
Figure 5:
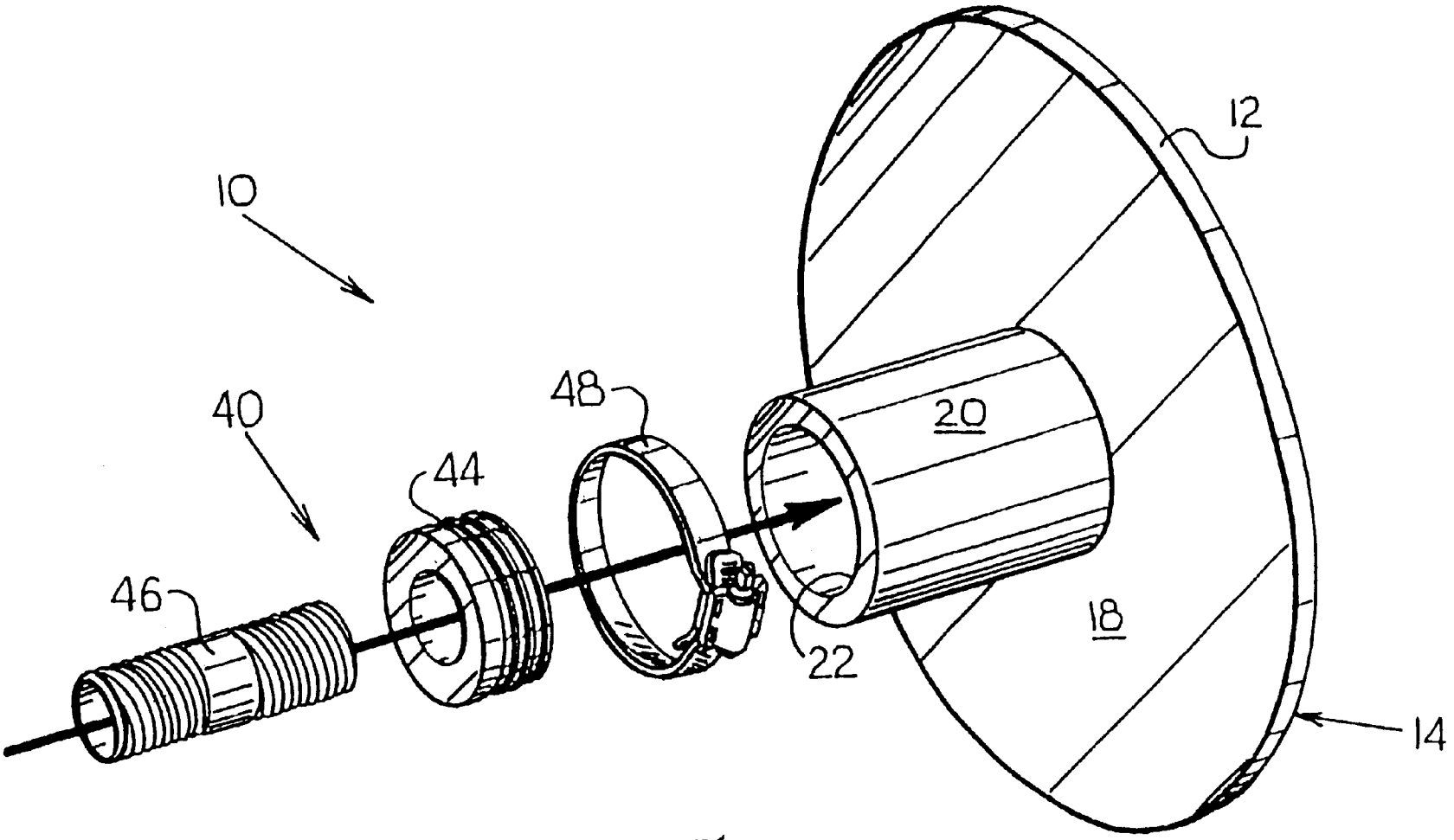
FIG. 5 is an exploded perspective view of the diffuser shown in FIG. 1.

The base member 12 includes a first side 16 and a second side 18. As shown in FIGS. 3 and 4, the base member 12 has an inlet conduit 20 depending from the second side 18. The inlet conduit 20 defines a central bore 22 extending through the base member 12. The central bore 22 includes a dome inlet opening 24. The base member 12 is preferably a unitary piece that is made of high durometer rubber of about 90 Shore "A", such as SBR (styrene-butadiene). The base member 12 provides strength and stiffness to the diffuser 10. The base member 12 may further include a metal reinforcing plate or wire mesh screen positioned within the base member 12. The plate or screen (not shown) may be encapsulated within the base member 12. An exemplary thickness for the base member 12 is about 0.50 inches.

Figure 1:
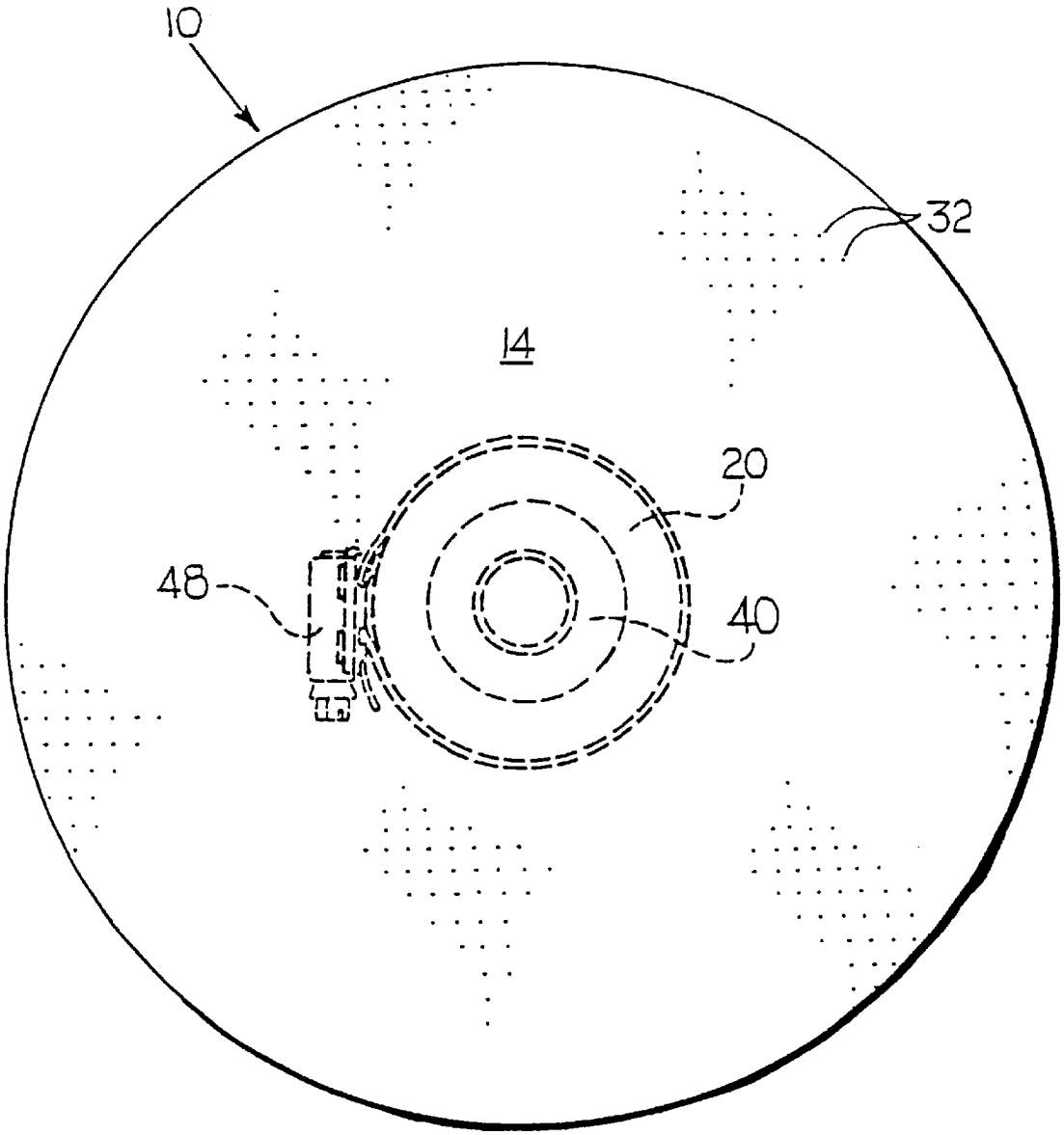
FIG. 1 is a plan view of a first preferred embodiment of a diffuser made in accordance with the present invention.
Figure 2:
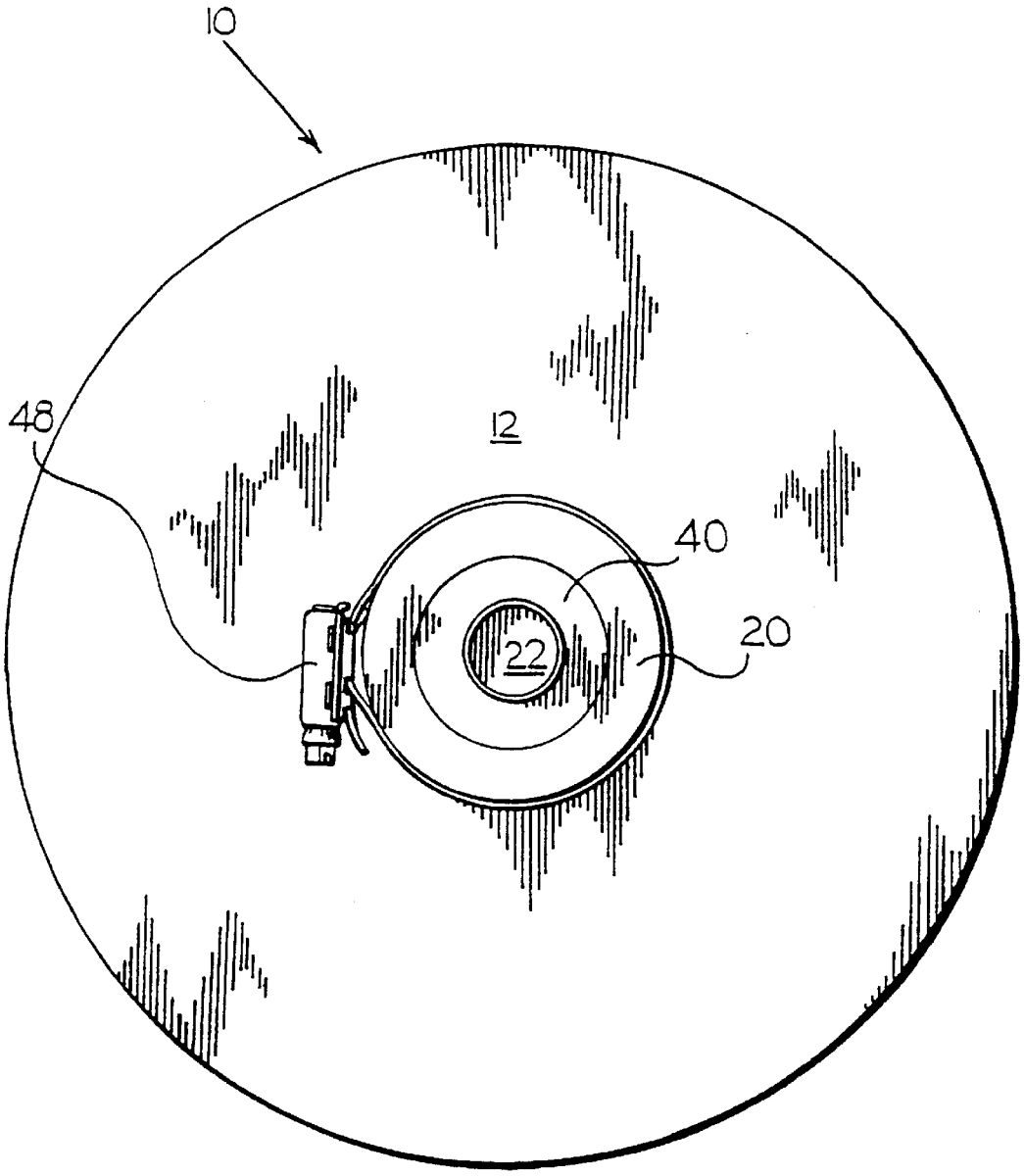
FIG. 2 is a bottom plan view of the diffuser shown in FIG. 1.
Figure 17:
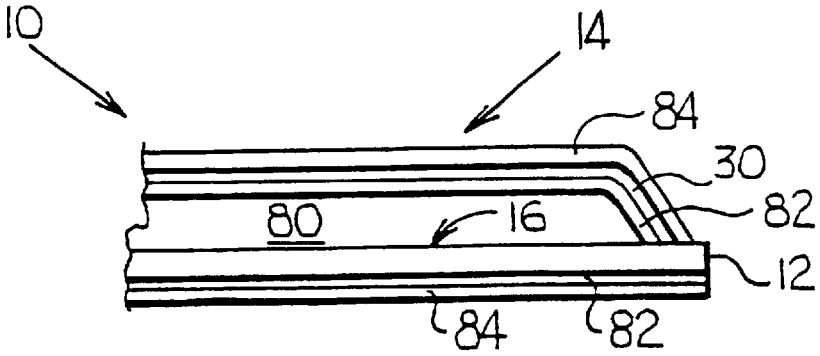
FIG. 17 is a schematic view of the diffuser shown in FIG. 1, in the pressurized state with the diffuser having a fabric reinforced elastomer layer.

The resilient dome member 14 (hereinafter "the dome member 14") is sealed to the first side 16 of the base member 12 at a peripheral edge of the first side 16 of the base member 12, as shown in FIG. 4. The dome member 14 may be comprised of a single ply resilient membrane 30, as shown in FIG. 4, or comprised of a plurality of individual plies defined in a stacked configuration, as shown in FIG. 17 discussed hereinafter. Each of the plies will be at least partially sealed to the ply lying underneath, as will be appreciated by those skilled in the art. The single membrane 30, as shown in FIG. 4, is sealed to the first side 16 of the base member 12 at the peripheral edge of the first side 16 of the base member 12. As shown in FIGS. 1 and 4, the dome member 14 and, hence, the membrane 30 define a plurality of perforated holes 32 extending therethrough. If a dome member 14 made of multiple plies is used, each of the plies will have perforated holes. A suitable distribution for the plurality of perforated holes 32 is about 32 holes/inch$^2$. An exemplary thickness for the membrane 30 defining the dome member 14 is approximately 0.19 inches. The dome member 14 may include a nonperforated area or region 34 positioned opposite from the inlet opening 24 of the central bore 22. The nonperforated area 34 preferably has a circular shape and an exemplary diameter of about two inches. However, the nonperforated area 34 can have any suitable size or shape so long as it is large enough to close off the dome inlet opening 24 of the central bore 22. The nonperforated area 34 of the dome member 14 prevents backflow of liquid or material through the central bore 22, as will be discussed fully hereinafter. The nonperforated area 34 of the dome member 14 operates as a check valve when the dome member 14 is in a collapsed state by preventing sludge and organic matter from entering the dome inlet opening 24 of the central bore 22. The dome member 14 is preferably made of an elastomeric material, such as a low durometer rubber of about 45 Shore "A", such as neoprene. The dome member 14 is much thinner than the base member 12 and designed for flexibility and resiliency.

Figure 6:
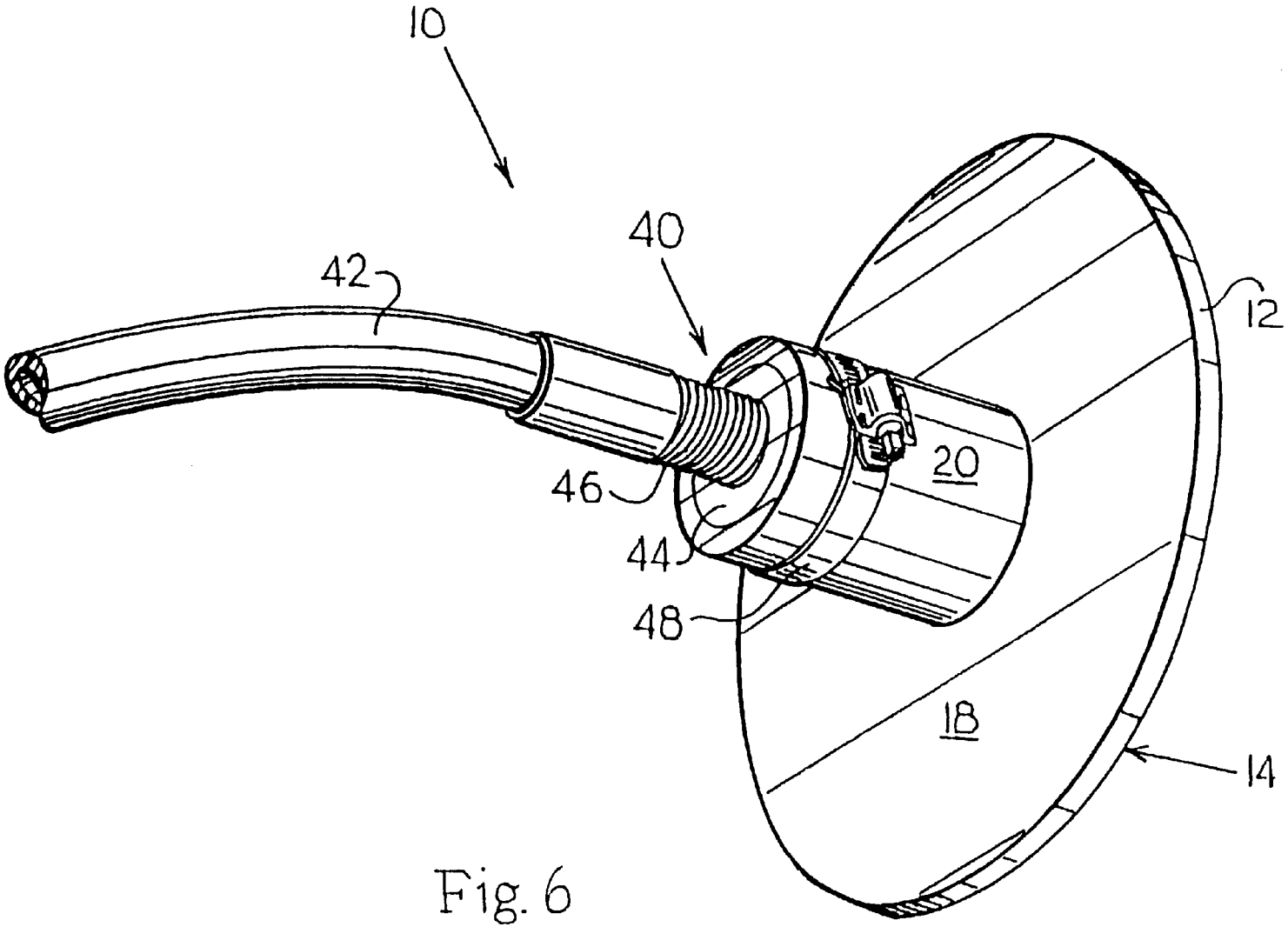
FIG. 6 is a perspective view of the diffuser shown in FIG. 1, with the diffuser attached to a conduit.

Referring now to FIGS. 3–6, a coupling member 40 is at least partially positioned within the central bore 22. The coupling member 40 is configured to cooperate with an external process fluid source (not shown) through a hose or pipe 42 (shown in FIG. 6). The coupling member 40 shown in FIGS. 3–6 is a threaded fitting that includes a first member 44 positioned within the central bore 22 and a second member 46 in threaded engagement with the first member 44. The second member 46 projects from the central bore 22 and, as shown in FIG. 6, cooperates with the hose or pipe 42 leading to the external process fluid source. A clamp 48 is preferably positioned around the inlet conduit 20 of the base member 12 to provide a fluid-tight seal between the inlet conduit 20 and the coupling member 40.

Figure 7:
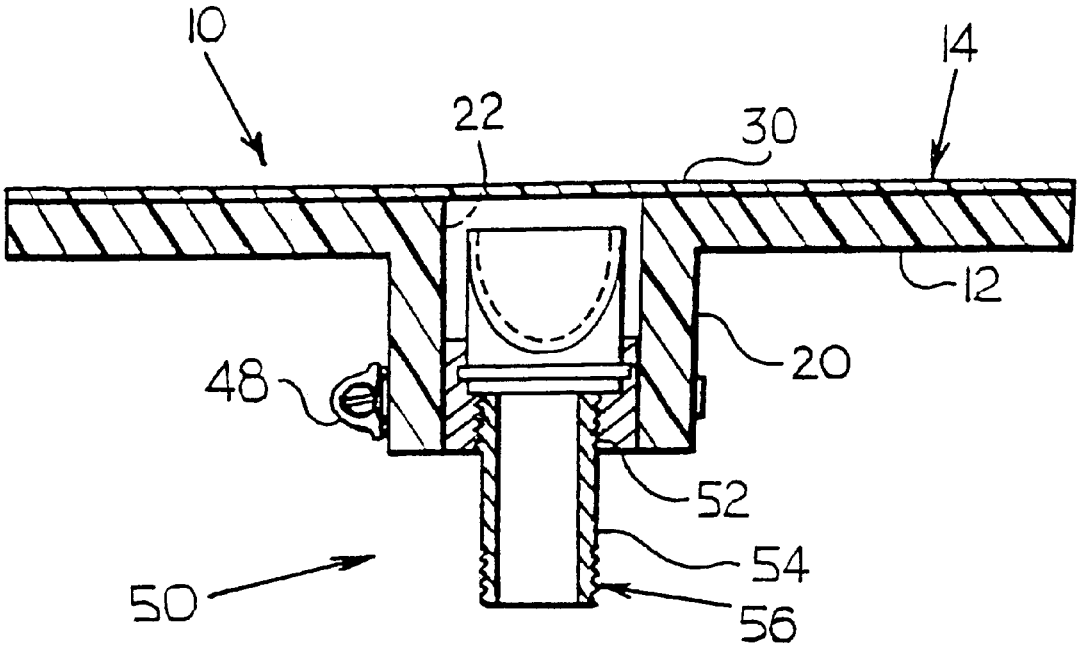
FIG. 7 is a cross-sectional view of the diffuser shown in FIG. 1, with the diffuser having a check valve positioned therein.
Figure 8:
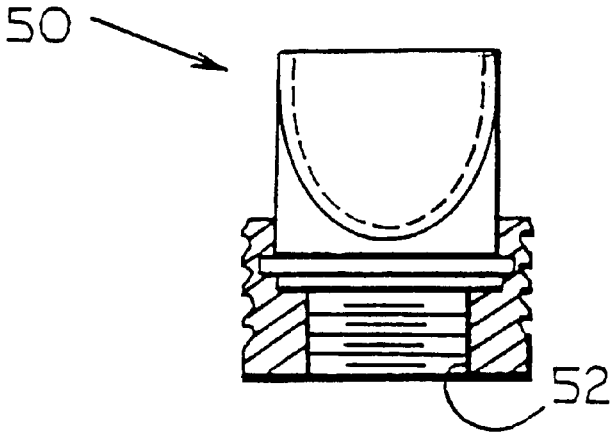
FIG. 8 is an elevational view in partial cross section of the check valve shown in FIG. 7.
Figure 9:
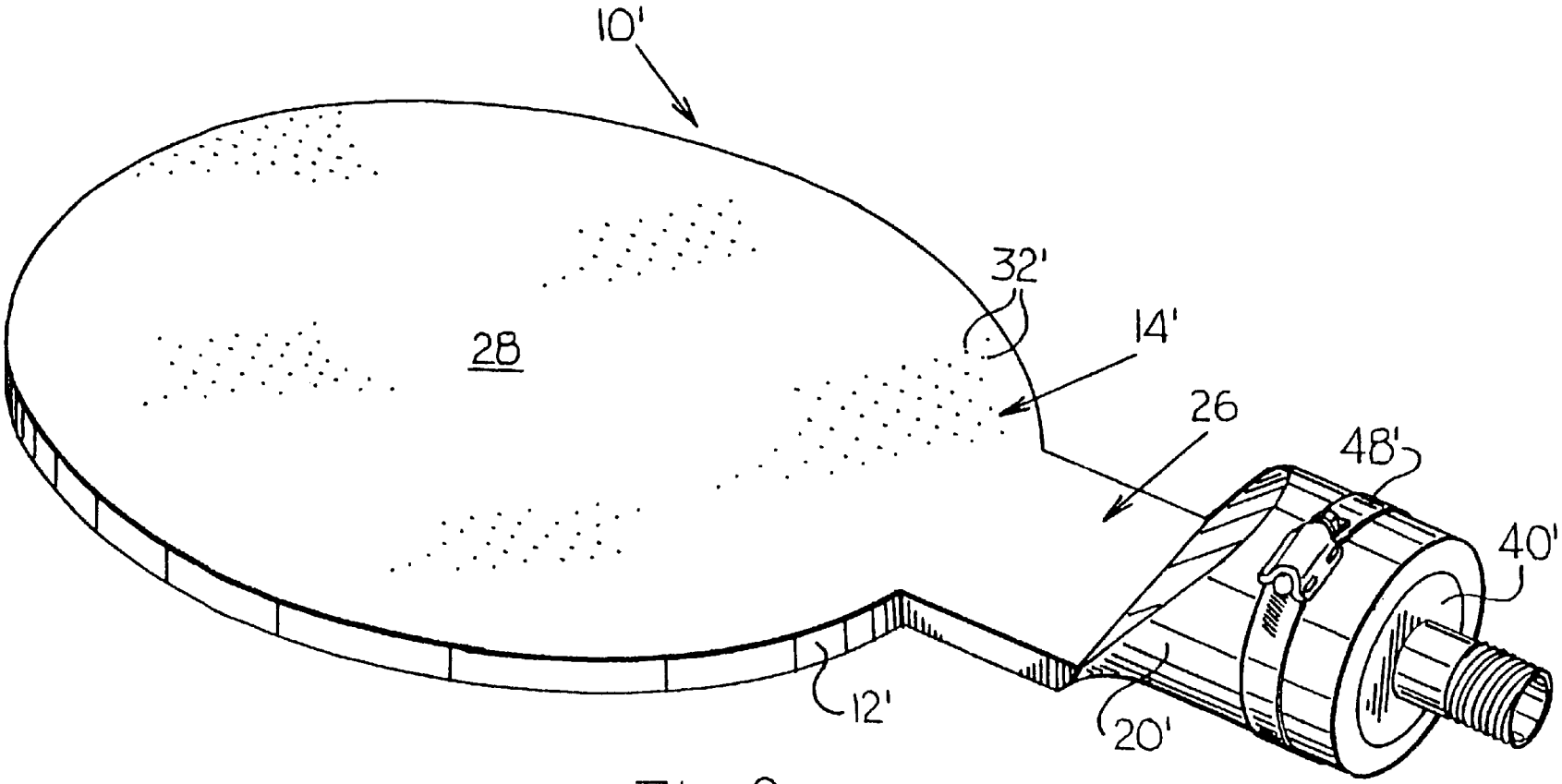
FIG. 9 is a perspective view of a second embodiment of the diffuser made in accordance with the present invention.
Figure 10:
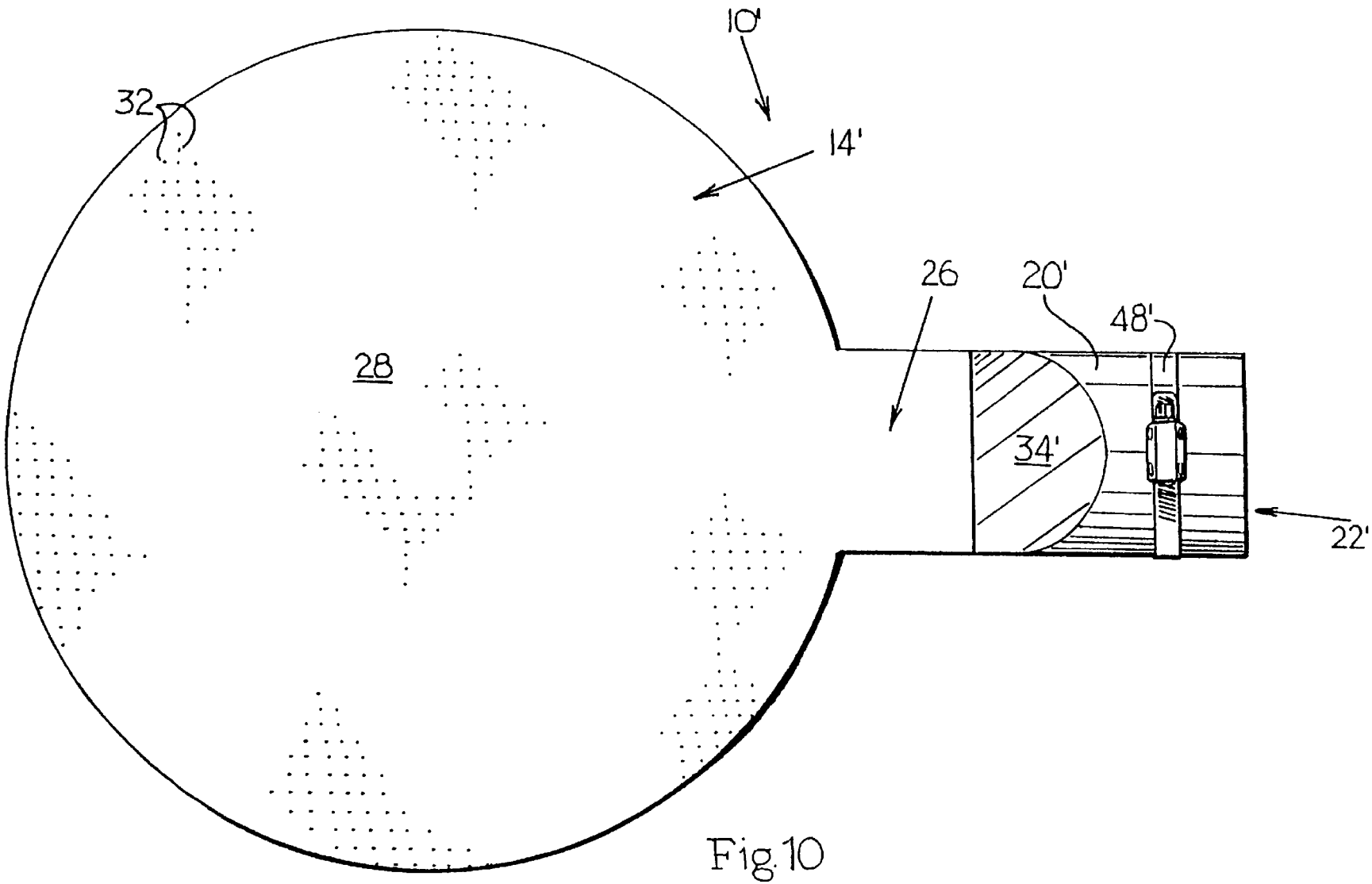
FIG. 10 is a plan view of the diffuser shown in FIG. 9.
Figure 11:
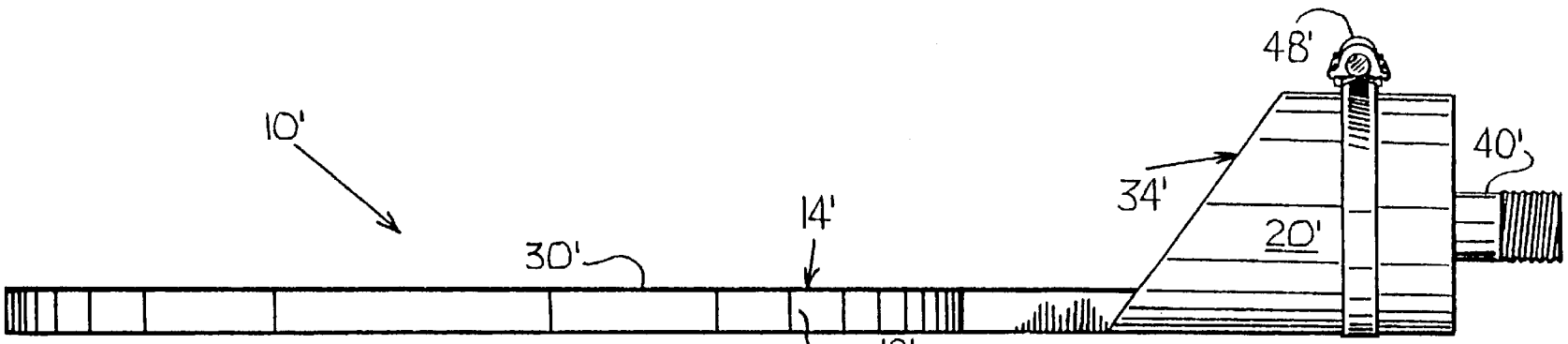
FIG. 11 is a side view of the diffuser shown in FIG. 9.
Figure 12:
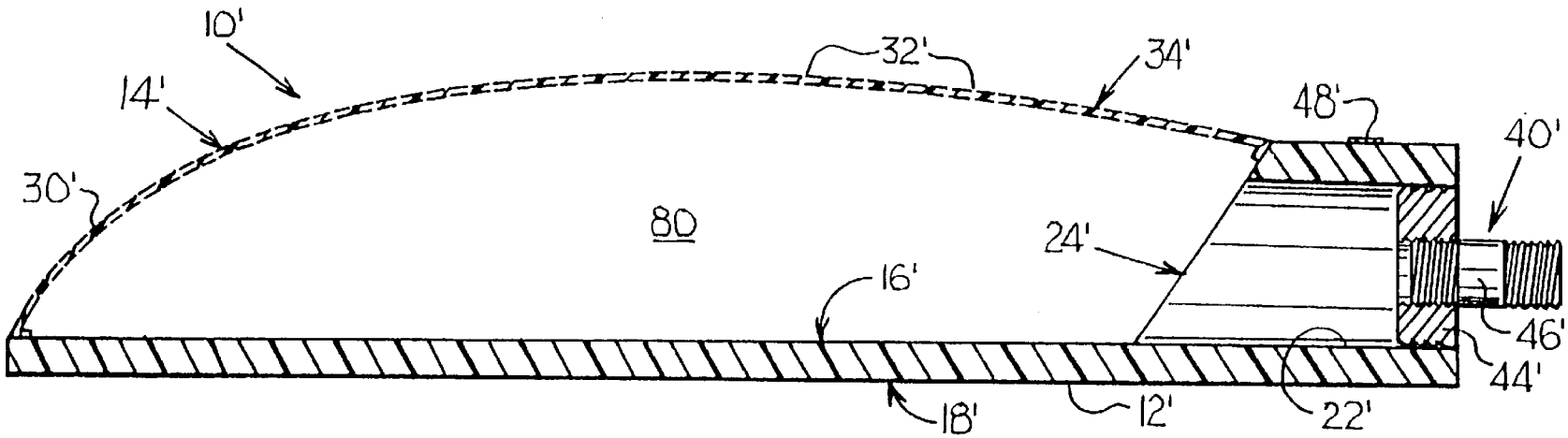
FIG. 12 is a cross-sectional view of the diffuser shown in FIG. 9, with the diffuser in a pressurized state.

Referring to FIGS. 7 and 8, in a presently most preferred embodiment of the diffuser 10 the coupling member 40 is a check valve So positioned within the central bore 22 of the base member 12. The check valve 50 includes an internally threaded portion 52. A short threaded nipple 54 is in threaded engagement with the internally threaded portion 52 in a similar manner to the first and second members 44, 46 discussed hereinabove. The nipple 54 projects out of the central bore 22 defined by the inlet conduit 20 and includes an externally-threaded portion 56 configured to coact with the hose or pipe 42, shown in FIG. 6, connected to the external process fluid source. The clamp 48 is also used with the check valve embodiment of the diffuser 10. The clamp 48 is positioned around the inlet conduit 20 at a position coextensive with the internally threaded portion 52 of the check valve 50. The clamp 48 provides a fluid-tight seal between the inlet conduit 20 and the check valve 50, as will be appreciated y those skilled in the art. A suitable check valve 50 adaptable for use, in particular, in air diffuser applications, is described in U.S. Pat. No. 4,607,663 incorporated herein by reference. Other "duckbill" type check valves may be suitable for use in construction of the present invention. The check valve 50 prevents any backflow or sludge or other materials into the hose or pipe 42, should such material be introduced inside the central bore 22 resulting from a leak in or catastrophic failing of the dome member 14.

It will be further appreciated by those skilled in the art that the base member 12, the dome member 14 and the coupling member 40 may be made as a single, unitary piece. In this alternative embodiment of the diffuser 10, the dome member 14 and the coupling member 40 are integrally formed as part of the base member 12. In addition, the diffuser 10 can take the form of geometric shapes other than the circular shape shown in FIGS. 1 and 2. For example, the diffuser 10 can have a rectangular, square or other polygonal shape. Finally, flanged connections may be utilized in place of the threaded connections between the first and second members 44, 46, and between the check valve 50 and the nipple 54.

Referring to FIGS. 9–13, a second embodiment of the diffuser made in accordance with the present invention is shown and designated with reference number 10'. The diffuser 10' is generally similar to the diffuser 10 discussed hereinabove, but has a horizontal construction instead of the annular construction embodied by the diffuser 10.

The diffuser 10' generally includes a unitary and substantially rigid base member 12' and a resilient and inflatable dome member 14' connected to the base member 12'. The base member 12' includes a first side 16' and a second side 18'. The base member 12' further includes a longitudinally extending inlet conduit 20'. The inlet conduit 20' includes a dome inlet opening 24'.

The dome member 14' is sealed to the first side 16' of the base member 12' at the peripheral edge of the first side 16' of the base member 12'. The dome member 14' includes a single ply or multiple plies in a similar manner to the diffuser 10 discussed hereinabove. The dome member 14' is sealed to the first side 16' of the base member 12' so that a first portion 26 of the dome member 14' encloses the inlet conduit 20' and the dome inlet opening 24'. A second portion 28 of the dome member 14' and, hence, the membrane 30 define a plurality of perforated holes 32' extending therethrough as shown, in particular, in FIGS. 9 and 10. The first portion 26 of the dome member 14' may include a nonperforated region or area 34' located opposite the dome inlet opening 24' of the inlet conduit 20'. The nonperforated area 34' has a suitable size and shape to close off the dome inlet opening 24' of the inlet conduit 20' to prevent backflow of liquid or material therethrough. All other parameters for the base member 12' and the dome member 14' are similar to the base member 12 and the dome member 14 discussed previously.

A coupling member 40' is at least partially positioned within the inlet conduit 20' and configured to connect to an external process fluid source (not shown) through a hose or pipe (not shown). The coupling member 40' may be a threaded fitting or a flanged fitting that includes a first member 44' and a second member 46' in threaded engagement with the first member 44'. However, the coupling member 40' is preferably a check valve 50' that includes an inlet end 60 and an outlet end 62. A clamp 48' is provided around the inlet conduit 20' of the base member 12' to provide a fluid-tight seal between the inlet conduit 20' and the check valve 50'. As with the diffuser 10, the entire diffuser 10' may be fabricated as one integral unit.

Figure 15:
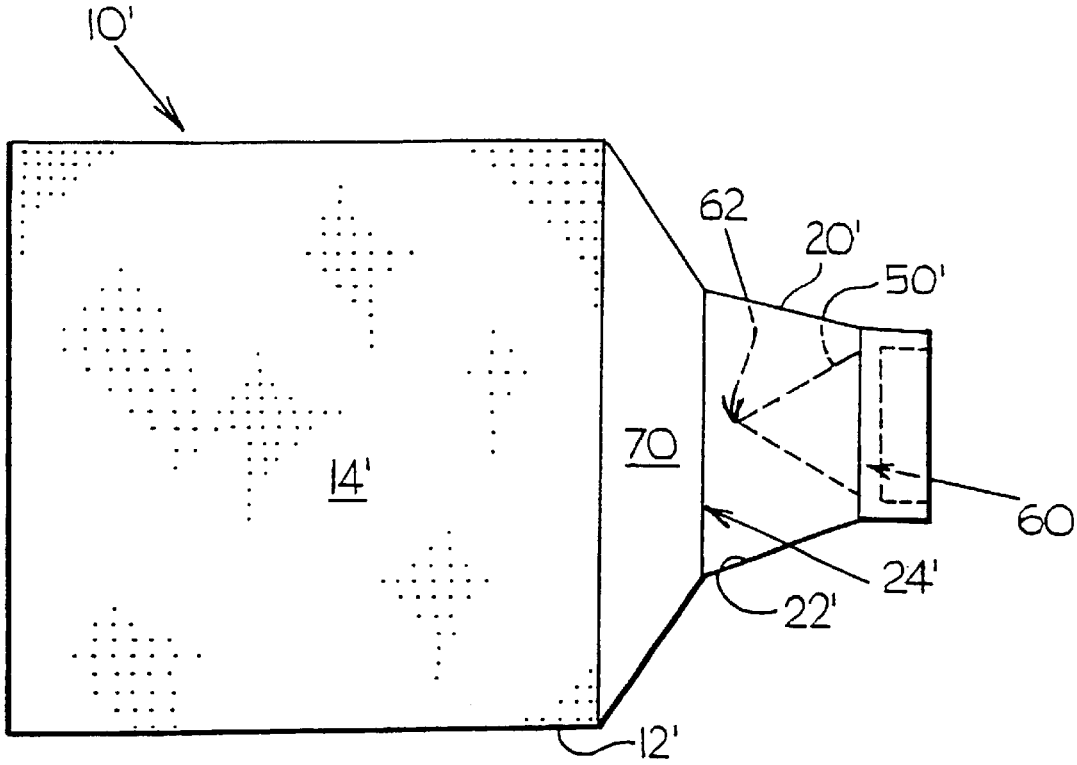
FIG. 15 is a plan view of the diffuser shown in FIG. 14, with the diffuser having a rectangular shape.
Figure 14:
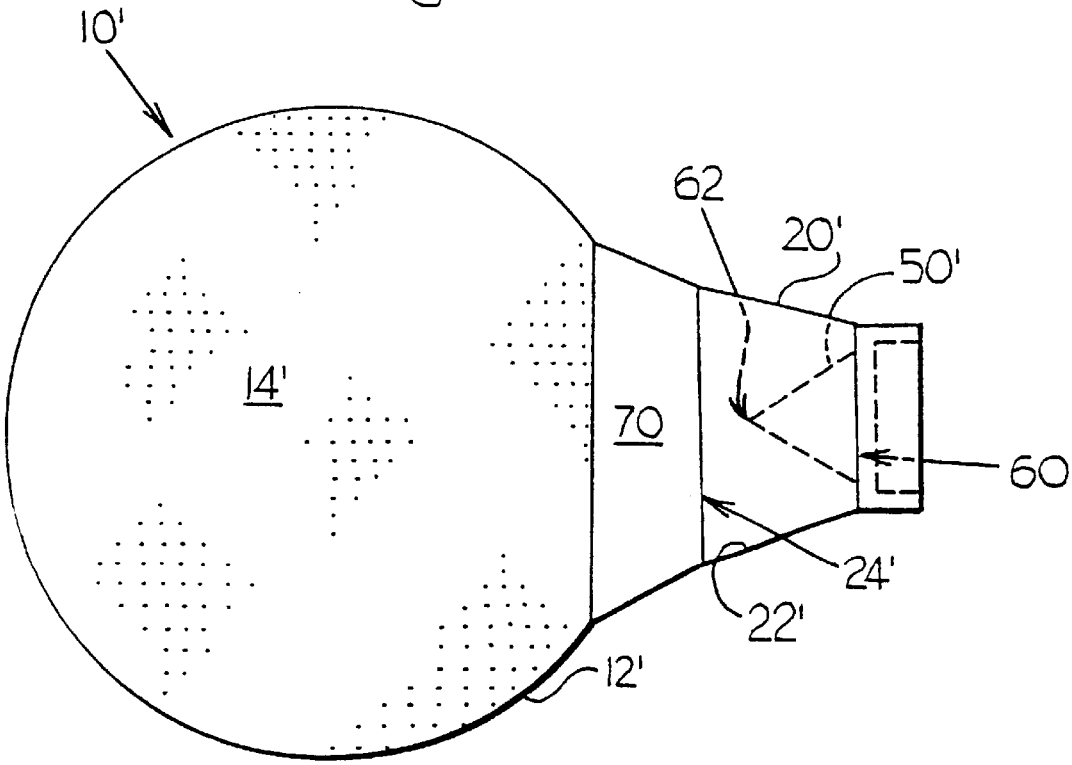
FIG. 14 is a plan view of an alternative embodiment of the diffuser shown in FIG. 9 with a check valve positioned therein.
Figure 16:
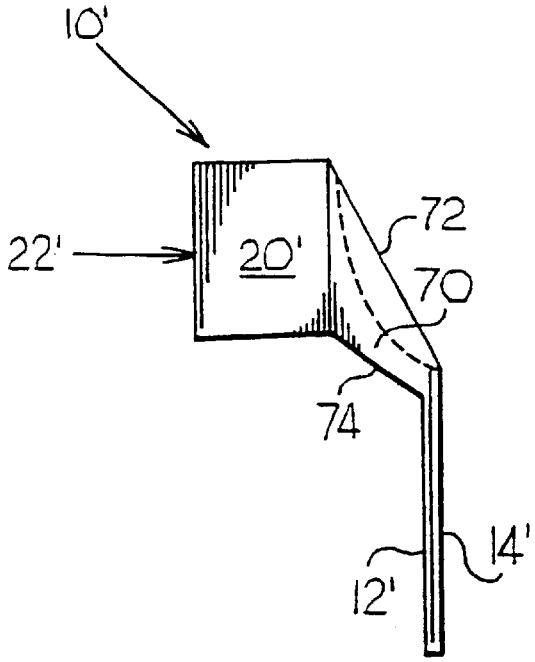
FIG. 16 is a side view of a third embodiment of the air diffuser made in accordance with the present invention, with the diffuser in a vertical orientation.
Figure 13:
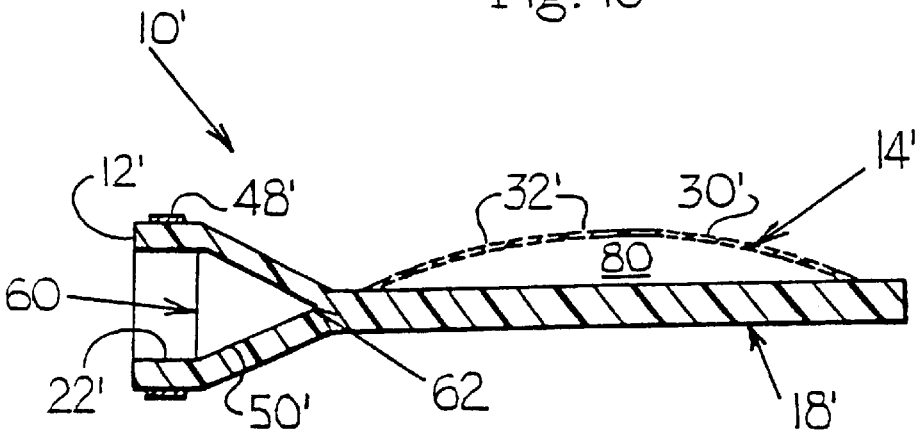
FIG. 13 is a cross-sectional view of the diffuser shown in FIG. 9, wish the diffuser having a check valve positioned therein and showing the diffuser in the pressurized state in phantom.

Referring to FIGS. 14–16, an alternative embodiment of the diffuser 10' made in accordance with the present invention is shown. In the alternative embodiment, a flop zone 70 is formed by the base member 12' and the dome member 14' adjacent the inlet opening 24' of the inlet conduit 20'. The flop zone 70 is in fluid communication with the outlet end 62 of the check valve 50'. The flop zone 70 has a thin upper membrane 72 formed by the dome member 14' and a stiffer, thicker lower lip 74 defined by the base member 12'. The purpose of the flop zone 70 is to allow the dome member 14' to bend with respect to the lower lip 74 of the flop zone 70, so that the diffuser 10' may be positioned in a vertical orientation, as shown in FIG. 16. This vertical orientation of the diffuser 10' occurs when the process fluid is no longer being supplied to the diffuser 10'. When pressurized, the flop zone 70 and dome member 14' straighten to a horizontal position. The vertical orientation provides a reduced likelihood of solids packing within the perforations 32'.

Referring to FIGS. 4–8, operation of the diffuser 10 made in accordance with the present invention will now be discussed. In operation, the coupling member 40, or more particularly, the check valve 50 is connected to a compressed air supply source, such as an air compressor (not shown), through the hose or pipe 42. The diffuser 10 may be one of many diffusers secured to headers in the bottom of an aeration tank roughly in the same manner as discussed previously in connection with known prior art diffusers. The flow of air from the air supply source opens the check valve 50, which allows compressed air to flow therethrough and into the central bore 22. Air flows through the central bore 22 and out the dome inlet opening 24. The air then begins to swell the dome member 14. When the dome member 14 has fully expanded, the air will escape out the perforations 32 defined in the dome member 14. A cavity 80 is thus formed between an inner surface of the dome member 14 and the first side 16 of the base member 12. This is the pressurized state of the diffuser 10. Depending on the shape of the dome member 14, the cavity 80 can be semicircular or polygonal in cross section. A semicircular cross section of the "dome" or cavity 80 is shown in FIG. 4. The polygonal-shaped cavity 80 is shown in FIG. 17, discussed hereinafter. After escaping the dome member 14, air continues its upward movement in the form of air bubbles.

In the event that the air supply to the diffuser 10 is shut off, the check valve 50 and the dome member 14 prevent backflow of sludge and other organic matter into the air supply source. The dome member 14 will collapse onto the relatively stiffer base member 12, thereby sealing the central bore 22 from backflow therethrough. In particular, the nonperforated area 34 will preferably settle over the dome inlet opening 24 and completely seal to the central bore 22 from backflow. This is the unpressurized state of the diffuser 10. Additionally, if sludge is able to backflow through the perforations 32 in the dome member 14 and enter the central bore 22, the check valve 50 provides a second barrier against further backflow toward the air supply source. The check valve 50, when closed, prevents reverse flow into the hose or pipe 42 connecting the diffuser 10 to the air supply source. It will be apparent that the perforations 32 can be sized to deliver different sized air bubbles in the aeration tank as required by the particular activated sludge process at hand.

The diffuser 10 can be made in many configurations. It can be made using various durometers of elastomer as well as fabric reinforced elastomer, depending on the stiffness required in any specific application. Volume of air and pressure needs can be controlled by varied construction of the fabric reinforced elastomer and varied durometers of rubber. All other parameters being the same, if the check valve 50 and dome member 14 are made stiffer, less air will flow; if made softer, more air will flow. The diffuser 10 may be circular- or rectangular-shaped or have any other geometric shape suitable for the specific application at hand, as shown in FIGS. 14 and 15. By changing the thickness and durometer of the dome member 14, the amount of air can be optimized. The user may optimize air flow by selecting the thickness and durometer of the dome member 14 or by using more or less holes or different diameter domes. FIG. 17 schematically shows the cross section of the dome member 14 when using the dome member 14 that is comprised of a plurality of individual plies. The dome member 14 may include an elastomer membrane 30 and a fabric reinforcement layer 82 positioned below the membrane 30. The layer 82 is preferably also provided in the base member 12. A cover layer 84 is preferably provided over the membrane 30 and the fabric reinforcement layer 82. The cover layer 84 is preferably Buna N synthetic rubber. The three layers are preferably vulcanized, and each of the layers 82, 84 and the membrane 30 defining the dome member 14 have perforated holes therethrough, as will be appreciated by those skilled in the art.

Referring to FIGS. 9–12, the diffuser 10' operates in a similar manner to the diffuser 10 with the exception that the process fluid enters along a longitudinal axis of the diffuser 10'. The nonperforated area 34' of the first portion 26 of the dome member 14' will collapse and block the dome inlet opening 24'. The nonperforated area 34' again operates as a check valve when the dome member 14' is in the collapsed state by covering the dome inlet opening 34' and preventing backflow through the inlet conduit 20'. The nonperforated area 34' and the check valve 50' positioned within the inlet conduit 20' together prevent backflow of sludge, organic matter and other debris into an air supply source, such as an air compressor and its controls.

The present invention thus provides an air diffuser which effectively prevents backflow of sludge, organic matter and other debris to an air supply source. In addition, the present invention provides an air diffuser having a check valve as a secondary barrier for preventing backflow to the air supply source. It should be understood that this invention is not limited to activated sludge applications but is useful anywhere it is desirable to inject and diffuse one process fluid (liquid, gas, powder, etc.) into another process fluid for the purpose of aeration, diffusion, agitation or mixing. Furthermore, the perforated holes defined in the dome member act as a third "check valve" due to the sealing of the dome member to the base member in the unpressurized state of the preferred embodiment of the diffuser.

The invention has been described with reference to the preferred embodiments which are merely illustrative of the present invention and not restrictive thereof. Obvious modifications and alterations of the invention may be made without departing from the spirit and scope of the invention. The scope of the present invention is defined in the appended claims and equivalents thereto.

What is claimed is:

1. A diffuser for diffusing a process fluid, comprising:

a base member having a first side and a second side, with the base member having an inlet conduit depending from the second side, wherein the inlet conduit defines a central bore extending through the base member;

a resilient dome member sealed to the first side of the base member at a peripheral edge of the first side of the base member, with the dome member defining a plurality of perforated holes extending therethrough; and a coupling member at least partially positioned within the central bore and configured to cooperate with an external process fluid source, wherein the coupling member is a check valve, wherein in a pressurized state of the diffuser the process fluid flows through the central bore and expands the dome member such that a cavity forms between an inner surface of the dome member and the first side of the base member, and wherein in the pressurized state of the diffuser the process fluid diffuses from the diffuser through the perforated holes in the dome member.

2. The diffuser of claim 1, wherein the dome member and the coupling member are integrally formed as part of the base member.

3. The diffuser of claim 1, wherein the dome member includes at least one elastomer ply with a plurality of perforated holes defined therethrough.

4. The diffuser of claim 1, wherein the dome member includes a nonperforated area opposite the central bore, and wherein in an unpressurized state of the diffuser the nonperforated area contacts the first side of the base member and seals the central bore from backflow therethrough.

5. The diffuser of claim 1, wherein the base member is made of a high durometer rubber of about 90 Shore A and the dome member is made of a low durometer rubber of about 45 Shore A.

6. The diffuser of claim 1, wherein a distribution of the plurality of perforated holes in the dome member is about 32 holes/inch$^2$.

7. The diffuser of claim 1, wherein in the pressurized state of the diffuser the cavity is semicircular-shaped in cross section.

8. The diffuser of claim 1, wherein in the pressurized state of the diffuser the cavity is polygonal-shaped in cross section.

9. A diffuser for diffusing a process fluid, comprising:

a base member having a first side and a second side, with the base member defining a longitudinally extending inlet conduit having an inlet opening;

a resilient dome member sealed to the first side of the base member at a peripheral edge of the first side such that a first portion of the dome member encloses the inlet conduit, with a second portion of the dome member defining a plurality of perforated holes extending therethrough; and a coupling member at least partially positioned within the inlet conduit and configured to cooperate with an external process fluid source, wherein the coupling member is a check valve, wherein in a pressurized state of the diffuser the process fluid flows through the inlet conduit such that the dome member expands and forms a cavity between an inner surface of the dome member and the first side of the base member, wherein in the pressurized state of the diffuser the process fluid diffuses through the perforated holes defined in the second portion of the dome member, and wherein in an unpressurized state of the diffuser the first portion of the dome member contacts the first side of the base member and seals the inlet opening from backflow.

10. The diffuser of claim 9, wherein the dome member and the coupling member are integrally formed as part of the base member.

11. The diffuser of claim 9, wherein the dome member includes at least one elastomer ply, with a plurality of perforated holes defined therethrough.

12. The diffuser of claim 9, wherein the first portion of the dome member includes a nonperforated area opposite the inlet opening of the inlet conduit, and wherein in an unpressurized state of the diffuser the nonperforated area contacts the first side of the base member and seals the inlet opening from backflow therethrough.

13. The diffuser of claim 9, wherein the base member is made of a high durometer rubber of about 90 Shore A and the dome member is made of a low durometer rubber of about 45 Shore A.

14. The diffuser of claim 9, wherein a distribution of the plurality of perforated holes in the dome member is about 32 holes/inch$^2$.

15. The diffuser of claim 9, wherein in the pressurized state of the diffuser the cavity is semicircular-shaped in cross section.

16. The diffuser of claim 9, wherein in the pressurized state of the diffuser the cavity is polygonal-shaped in cross section.

17. The diffuser of claim 9, further including a longitudinally extending flop zone formed by the base member and the dome member adjacent the inlet opening of the inlet conduit.

* * * * *

UNITED STATES PATENT AND TRADEMARK OFFICE

CERTIFICATE OF CORRECTION

PATENT NO. : 6,367,783 B1
DATED : April 9, 2002
INVENTOR(S) : Spiros G. Raftis

It is certified that error appears in the above-identified patent and that said Letters Patent is hereby corrected as shown below:

Title page,
Item [60], Related U.S. Application Data, "60/000,599" should read -- 60/090,599 --.

Column 3,
Line 33, "wish" should read -- with --.

Column 4,
Line 58, "check valve So" should read -- check valve 50 --.

Signed and Sealed this

Twenty-ninth Day of October, 2002

*Attest:*

*Attesting Officer*

JAMES E. ROGAN
*Director of the United States Patent and Trademark Office*

UNITED STATES PATENT AND TRADEMARK OFFICE
Certificate

Patent No. 6,367,783 B1 Patented: April 9, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Spiros G. Raftis, Pittsburgh, PA; and Jeffrey T. Kelly, Carnegie, PA.

Signed and Sealed this First Day of April 2003.

TOM G. DUNN
*Supervisory Patent Examiner*
Art Unit 1724